US010461405B2

(12) United States Patent
Xiong

(10) Patent No.: US 10,461,405 B2
(45) Date of Patent: Oct. 29, 2019

(54) ANTENNA MODULE AND ELECTRONIC DEVICE INCLUDING THE SAME

(71) Applicant: Beijing Xiaomi Mobile Software Co., Ltd., Beijing (CN)

(72) Inventor: Xiaofeng Xiong, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 52 days.

(21) Appl. No.: 15/912,289

(22) Filed: Mar. 5, 2018

(65) Prior Publication Data

US 2018/0254541 A1 Sep. 6, 2018

(30) Foreign Application Priority Data

Mar. 6, 2017 (CN) ..... 2017 1 0129121

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 5/378*** | (2015.01) |

(Continued)

(52) U.S. Cl.

CPC ..... *H01Q 1/243* (2013.01); *H01Q 1/38* (2013.01); *H01Q 5/378* (2015.01); *H01Q 9/0421* (2013.01); *H01Q 9/42* (2013.01); *H01Q 1/44* (2013.01)

(58) Field of Classification Search

CPC ..... H01Q 1/243

See application file for complete search history.

(56) References Cited

U.S. PATENT DOCUMENTS

| | | | |
|---|---|---|---|
| 8,489,162 | B1 | 7/2013 | Dou |
| 2014/0184449 | A1 | 7/2014 | Dong |
| 2015/0123871 | A1 | 5/2015 | Chang |

(Continued)

FOREIGN PATENT DOCUMENTS

| | | | |
|---|---|---|---|
| CN | 102368575 | A | 3/2012 |
| CN | 103415174 | A | 11/2013 |

(Continued)

OTHER PUBLICATIONS

European Search Report mailed in corresponding EP Patent Application No. 18160047.9, dated Jun. 26, 2018, 9 pages.

(Continued)

*Primary Examiner* — Hai V Tran
*Assistant Examiner* — Awat M Salih
(74) *Attorney, Agent, or Firm* — Arch & Lake LLP

(57) ABSTRACT

An antenna module and electronic device are provided. The antenna module includes a metal side frame and feed coupling stub with a long side spaced from an inner side of the metal side frame. The feed coupling stub and a middle frame are arranged in parallel between a display module and main board. First end of the feed coupling stub is electrically connected with a grounding part of the main board to form first grounding point. The feed coupling stub is electrically connected with a radiofrequency module of the main board through a contact point to form a feed point. A middle frame connecting part, adjacent to second end of the feed coupling stub, forms second grounding point. A slot is opened between the inner side and a side of the display module substantially paralleled to the long side of the feed coupling stub.

18 Claims, 6 Drawing Sheets

(51) Int. Cl.
*H01Q 1/38* (2006.01)
*H01Q 1/44* (2006.01)

(56) References Cited

U.S. PATENT DOCUMENTS

2016/0164167 A1* 6/2016 Choi ..... H01Q 1/243
343/702
2016/0164168 A1* 6/2016 Choi ..... H01Q 1/48
343/702
2016/0315651 A1* 10/2016 Hong ..... H04B 1/3888
2017/0331189 A1* 11/2017 Wang ..... H01Q 9/04

FOREIGN PATENT DOCUMENTS

EP 3012905 A1 4/2016
EP 3032647 A2 6/2016

OTHER PUBLICATIONS

State Intellectual Property Office of the People's Republic of China, Office Action and Search Report Issued in Application No. 201710129121X, dated Jan. 3, 2019, 9 pages, (Submitted with MachineTranslation).

* cited by examiner

ANTENNA MODULE AND ELECTRONIC DEVICE INCLUDING THE SAME

CROSS REFERENCE TO RELATED APPLICATION

This patent application claims the priority to the Chinese Patent Application No. 201710129121.X filed on Mar. 6, 2017, the entire content of which is incorporated herein by reference.

TECHNICAL FIELD

The present disclosure relates to the field of communication technology.

BACKGROUND

Most electronic devices have a metal side frame or metal shell structure. For example, the side frame and/or back cover of the entire device may be made of metal except for its front screen so that the entire device has a very expressive appearance with a strong metallic feeling, and has a largely-increased structural strength. However, such a metal side frame or shell structure greatly reduce clearance of antenna, which brings many difficulties to antenna design.

Thus, it may be considered that the metal side frame may be cut off at an antenna-related position and the cut-off part may be filled up with non-metal material to reserve a given clearance for the antenna so that the antenna can radiate signals out.

SUMMARY

In view of this, an example of the present disclosure provides an antenna module and an electronic device to solve shortages in the related art.

According to a first aspect of the present disclosure, there is provided an antenna module which is arranged in an electronic device. The antenna module may include: a metal side frame comprising a breaking seam, and a feed coupling stub, where a long side of the feed coupling stub is spaced at a preset distance from an inner side of the metal side frame. The feed coupling stub and a middle frame of the electronic device are arranged in parallel between a display module and a main board of the electronic device. The inner side of the metal side frame is connected with a side of the middle frame through middle frame connecting parts. A first end that is on the feed coupling stub and adjacent to the breaking seam is electrically connected with a grounding part of the main board to form a first grounding point of the antenna module. The feed coupling stub is electrically connected with a radiofrequency module of the main board through a contact point to form a feed point of the antenna module. The middle frame connecting part adjacent to a second end of the feed coupling stub forms a second grounding point of the antenna module. A slot is opened between the inner side of the metal side frame and a side that is on the display module and substantially parallel to the long side of the feed coupling stub.

According to a second aspect of the present disclosure, there is provided an electronic device including: a display module; a main board; and a middle frame between the display module and the main board. The display module is carried on the top of middle frame and the main board is connected to the bottom of the middle frame. The electronic device further includes an antenna module including: a metal side frame with a breaking seam; and a feed coupling stub. A long side of the feed coupling stub is spaced at a preset distance from an inner side of the metal side frame. The feed coupling stub and the middle frame are arranged in parallel between the display module and the main board. A side of the middle frame is connected with the inner side of the metal side frame through middle frame connecting parts. A first end that is on the feed coupling stub and adjacent to the breaking seam is electrically connected with a grounding part of the main board to form a first grounding point of the antenna module. The feed coupling stub is electrically connected with a radiofrequency module of the main board through a contact point to form a feed point of the antenna module. The middle frame connecting part adjacent to a second end of the feed coupling stub forms a second grounding point of the antenna module. A slot is opened between the inner side of the metal side frame and a side that is on the display module and substantially parallel to the long side of the feed coupling stub.

It is to be understood that the above general descriptions and the below detailed descriptions are only illustrative and explanatory and therefore cannot be limiting of the present disclosure.

BRIEF DESCRIPTION OF DRAWINGS

The accompanying drawings herein which are incorporated in the description and constitute part of the description, illustrate examples consistent with the present disclosure and serve to explain the principle of the present disclosure together with the description.

DETAILED DESCRIPTION

Figure 1:
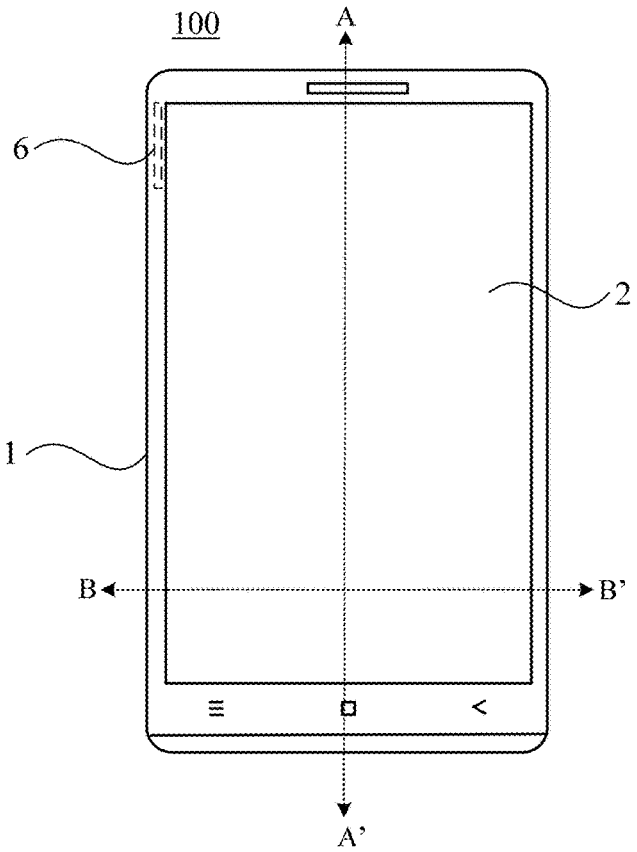
FIG. 1 is a schematic diagram illustrating external appearance of an electronic device including an antenna module according to an example of the present disclosure.

Example embodiments will be described in detail herein with the examples thereof expressed in the drawings. When the following descriptions involve the drawings, like numerals in different drawings represent like or similar elements unless stated otherwise. The implementations described in the following example embodiments do not represent all implementations consistent with the present disclosure. On the contrary, they are examples of a device and a method consistent with some aspects of the present disclosure described in detail in the appended claims.

The terminology used in the present disclosure is for the purpose of describing a particular example only, and is not intended to be limiting of the present disclosure. The singular forms such as "a", "said", and "the" used in the present disclosure and the appended claims are also intended to include multiple, unless the context clearly indicates otherwise. It is also to be understood that the term "and/or" as used herein refers to any or all possible combinations that include one or more associated listed items.

It is to be understood that although different information may be described using the terms such as first, second, third, etc. in the present disclosure, these information should not be limited to these terms. These terms are used only to distinguish the same type of information from each other. For example, the first information may also be referred to as the second information without departing from the scope of the present disclosure, and similarly, the second information may also be referred to as the first information. Depending on the context, the word "if" as used herein may be interpreted as "when" or "as" or "determining in response to."

An antenna module is a necessary component for an electronic device to realize a wireless communication function. An example of the present disclosure provides an antenna module which may be applied in an electronic device having a wireless communication function, for example, in the devices such as a smart phone, a tablet device, a personal digital assistant, a wearable device, for example, a smart watch.

Figure 2:
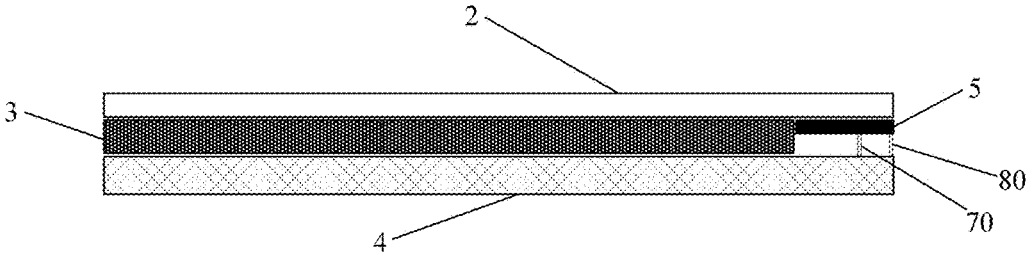
FIG. 2 is a schematic diagram illustrating a section of the structure shown in FIG. 1 along the direction of AA'.
Figure 3:
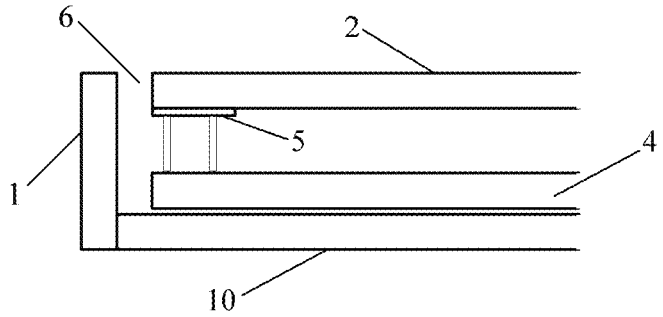
FIG. 3 is a schematic diagram illustrating a section of the structure shown in FIG. 1 along the direction of BB'.
Figure 4A:
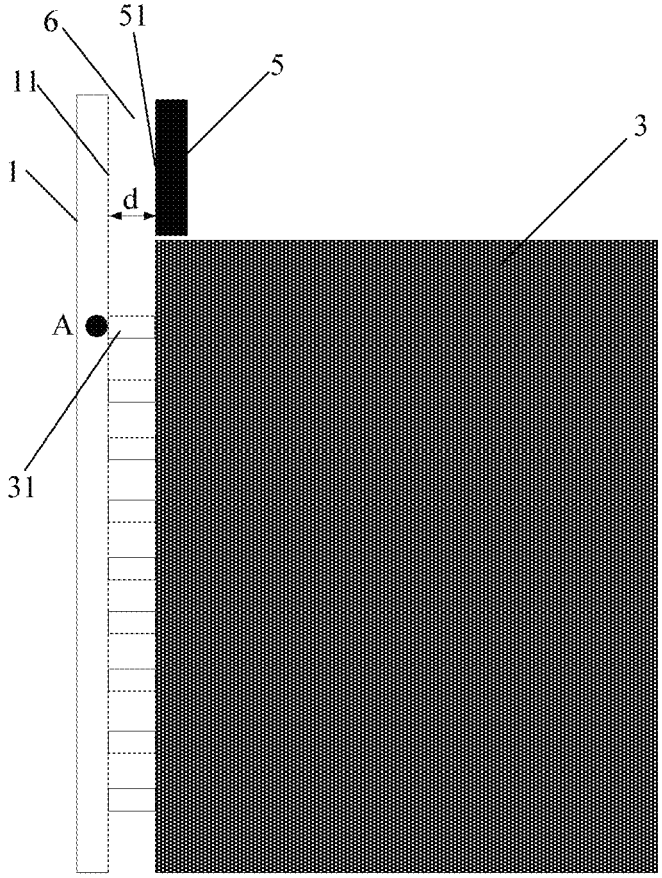
FIG. 4A is a schematic diagram illustrating connection of a middle frame and a metal side frame according to an example of the present disclosure.
Figure 4B:
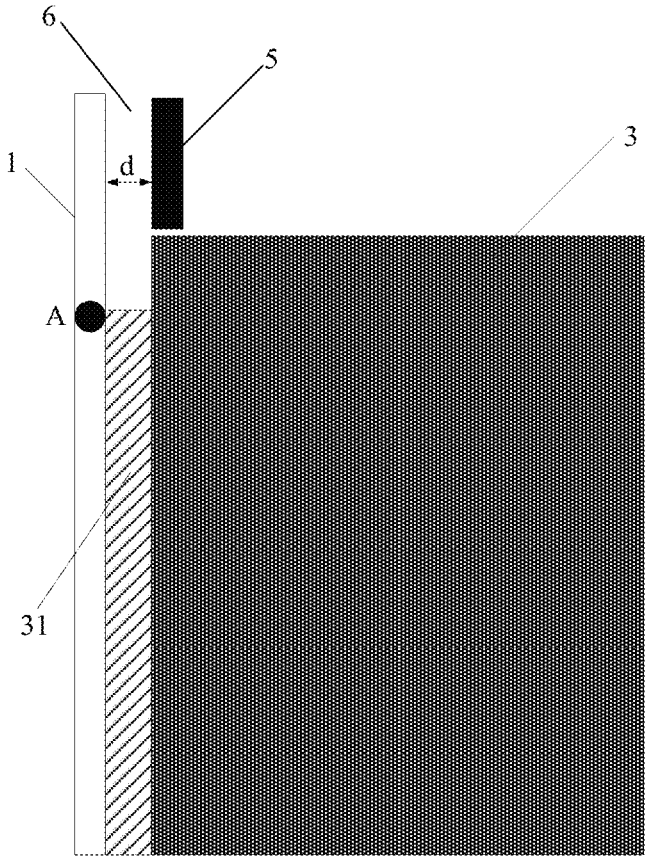
FIG. 4B is a schematic diagram illustrating connection of a middle frame and a metal side frame according to another example of the present disclosure.
Figure 5:
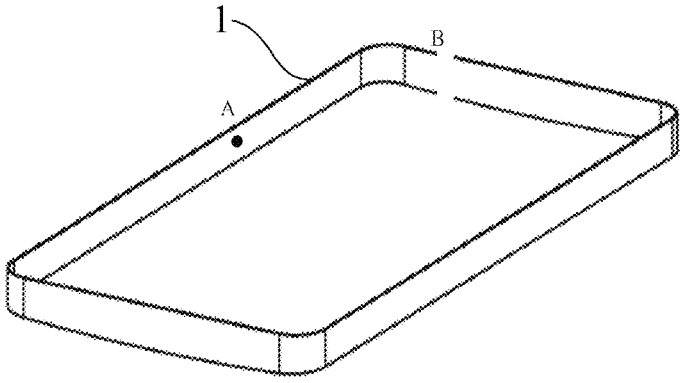
FIG. 5 is a schematic diagram illustrating a structure of a metal side frame according to an example of the present disclosure.
Figure 6:
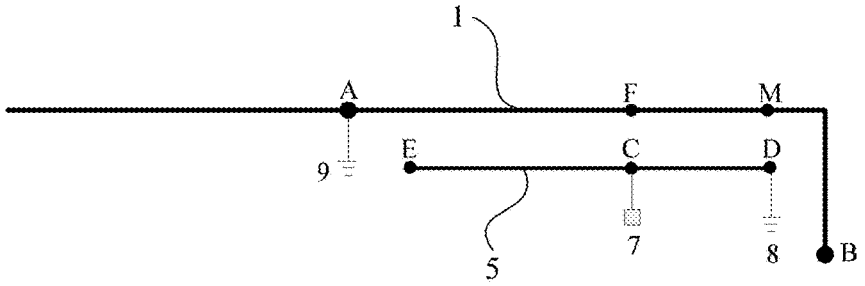
FIG. 6 is a schematic diagram illustrating an antenna module according to an example of the present disclosure.

FIG. 1 is a front view of an electronic device 100 including an antenna module according to an example of the present disclosure. FIG. 2 is a schematic diagram illustrating a section of the structure shown in FIG. 1 along the direction of AA'. FIG. 3 is a schematic diagram illustrating a section of the structure shown in FIG. 1 along the direction of BB'. FIG. 4A is a schematic diagram illustrating connection of a middle frame and a metal side frame according to an example of the present disclosure. FIG. 4B is a schematic diagram illustrating connection of a middle frame and a metal side frame according to another example of the present disclosure. FIG. 5 is a schematic diagram illustrating a structure of the metal side frame shown in FIG. 1 according to an example of the present disclosure. FIG. 6 is a schematic diagram illustrating a structure of an antenna according to an example of the present disclosure. The following examples are mainly illustrated in the case of the antenna module being applied in a cell phone.

As shown in FIGS. 1 to 6, an antenna module provided in an example of the present disclosure may include a metal side frame 1 with a breaking seam, a feed coupling stub 5, and a slot 6 that is opened on a front face of a cell phone and formed jointly with a middle frame 3, a display module 2 and a main board 4 of the cell phone. The metal side frame 1 at least partially surrounds the display module 2 of the electronic device 100. The breaking seam may be a small gap in the metal side frame 1.

At least one breaking seam may be opened on the metal side frame. Referring to FIG. 5 which is a schematic diagram illustrating a structure of a metal side frame according to an example of the present disclosure, the breaking seam is opened at a position B of an upper part of the metal side frame 1.

Based on the schematic diagrams shown in FIG. 4A and FIG. 4B, the feed coupling stub 5 may be a strip-shaped metal structure, for example, a strip-shaped metal sheet. A long side 51 of the feed coupling stub 5 is spaced at a preset distance d from an inner side 11 of the metal side frame 1. In an example of the present disclosure, the distance between the feed coupling stub and the inner side of the metal side frame may be different or same on different portions. All of the above figures illustrate a case where the distance is same on different portions, that is, the long side of the feed coupling stub is arranged to be parallel to the metal side frame.

As shown in FIG. 2, the feed coupling stub 5 and a middle frame 3 of the cell phone may be arranged in parallel between the display module 2 and the main board 4 of the cell phone.

The middle frame of the cell phone is located between the display module and a back cover of an electronic device and may be a metal skeleton for carrying different components in the cell phone, and the components may include parts such as a battery, a main board, a flex cable, a camera, different sensors, and a microphone.

As shown in FIG. 2, the display module 2 may be arranged on the top of the middle frame 3, and the main board 4 may be connected with the bottom of the middle frame 3. The length of the middle frame may be less than that of the display module 2 and the main board 4. The feed coupling stub 5 may be arranged in a space formed by the above structure and paralleled to the middle frame 3 below the display module 2.

FIG. 4A and FIG. 4B are schematic diagrams illustrating connection of the middle frame 3 and the metal side frame 1. A side of the middle frame 3 may be connected with the inner side 11 of the metal side frame 1 through middle frame connecting parts 31.

Referring to FIG. 2, FIG. 3 and FIG. 6, a contact point C may be provided on the feed coupling stub 5. The feed coupling stub 5 may be electrically connected with a radiofrequency module on the main board 4 at the position C so as to form a feed point 7 of the antenna module.

In an example of the present disclosure, the feed point 7 may be an I/O interface of the radiofrequency module on the main board 4, that is, the feed point may be a connecting point of the antennal module and the radiofrequency module.

For example, as shown in FIG. 2, the feed coupling stub 5 may be electrically connected at the contact point C with the radiofrequency module on the main board 4 through a first metal elastic sheet 70. The above radiofrequency module may include a receiver and a transmitter. A signal received by the antennal module may be transmitted to an input end of the receiver through the feed point. At the same time, a signal sent by the transmitter may be transmitted to an input end of the transmitting antenna through the feed point.

An end of the feed coupling stub 5 which is adjacent to a breaking seam position B of the metal side frame, i.e. a first end D, may be electrically connected with a grounding part on the main board 4 to form a first grounding point 8 of the antenna module. For example, as shown in FIG. 2, the first end D of the feed coupling stub 5 may be electrically connected with the grounding part on the main board 4 through a second metal elastic sheet 80.

As shown in FIGS. 4A, 4B, 5 and 6, the middle frame connecting part 31 that is adjacent to a second end E of the feed coupling stub 5 may be regarded as a second grounding point 9 of the antenna module. The middle frame connecting part 31 may be fixedly or moveably connected to a position A of inner side of the metal side frame 1. The middle frame connecting part 31 may be of metal.

In an example of the present disclosure, a slot may be opened between the metal side frame 1 and the corresponding display module above the feed coupling stub, and the slot and a slot formed between the feed coupling stub and the metal side frame may constitute the slot 6 shown in FIG. 1. A distance between the feed coupling stub and the metal side frame may be greater than or equal to that between the display module and the metal side frame. FIG. 3 illustrates a case where the above two distances are equal, that is, the outer long side of the feed coupling stub is aligned with the outer edge of a corresponding display module part above the feed coupling stub. In another example of the present disclosure, the outer long side of the feed coupling stub may not be aligned with the outer edge of the corresponding display module part but paralleled to or substantially paralleled to the outer edge. In another example of the present disclosure, the corresponding main board below the feed coupling stub may also be spaced at a particular distance from the metal side frame.

As shown FIG. 3, the above electronic device may also include a back cover 10. According to an example of this disclosure, the back cover may be made of metal or a non-metal material. If the structure shown in FIG. 2 is regarded as a combination, the slot 6 may be opened between the metal side frame 1 and the above combination and may be filled up with an insulating medium so that the above combination and the metal side frame 1 can be sealingly connected. The above insulating medium may include organic resin, toughened plastic, ceramics, safety glass, toughened glass and so on. The slot 6 may be opened on the front face of an electronic device such as a cell phone, that is, a front panel of the cell phone, or at a side of a liquid display screen. Wireless electromagnetic waves excited may be radiated to the sky through the slot on the front panel of the cell phone. The width d of the slot may range from 0.5 mm to 3 mm. More preferably, the width d of the slot may range from 0.5 mm to 1.5 mm.

In the present disclosure, the slot may be opened at an edge of a front panel of an electronic device. The slot may be sealed up and covered with a complex process during manufacture of the electronic device so that the slot will almost not affect the external appearance of the cell phone after injection-moulded, thereby increasing the aesthetic degree of the electronic device.

The above structure is illustrated in the case of the slot being opened at an upper left edge of the front panel of the cell phone. In another example of the present disclosure, the above slot may also be opened at a lower left edge, an upper right edge and a lower right edge at sides of the cell phone and paralleled to the sides of the metal side frame. The coupling stub and the breaking seam may be arranged in such a way that a structure similar to the antenna module is formed. In addition, there may be two or more breaking seams on the metal side frame. As long as one of the breaking seams satisfies the above structure, the influence of other breaking seams on the performance of the antenna module may be neglected.

In the antenna module shown in FIG. 6 according to an example of the present disclosure, B indicates a position of a breaking seam and an open stub is formed by a segment AB of the metal side frame 1. ECD indicates the feed coupling stub 5 and the feed point 7 is electrically connected to the contact point C. D indicates a first end that is on the feed coupling stub 5 and electrically connected with the first grounding point 8. D is adjacent to the breaking seam position B; E indicates the second end of the feed coupling stub and is adjacent to the second grounding point 9. The slot 6 is formed between the segment AB of the metal side frame and the feed coupling stub ECD.

The feed coupling stub 5 may be divided by the contact point C into a first coupling stub segment CD, and a second coupling stub segment CE.

An Inverted-F Antenna (IFA) may be formed by an electric connection structure of the feed coupling stub ECD, the feed point 7 and the first grounding point 8.

When the antenna module shown in FIG. 6 radiates out electromagnetic waves, the working process of the antenna is as follows: when excitation current of a first frequency band signal flows through the feed point 7, the contact point C and the first end D toward the first grounding point 8, the current may be excited onto the metal side frame by coupling the first coupling stub segment CD with a metal side frame segment FM. A resonance at a first preset frequency band may be formed jointly by the first coupling stub segment CD and the metal side frame segment AB. For example, the first preset frequency band may include a global positioning system (GPS) frequency band. The GPS frequency band may include two bands: one at 1575.42 MHz (10.23 MHz×154) called L1; and a second at 1227.60 MHz (10.23 MHz×120), called L2. The excited electromagnetic waves of the GPS frequency band may be radiated out from a breaking seam B.

When excitation current corresponding to a second frequency band signal is fed at the contact point C through the feed point 7, electric charge is mainly distributed on the second coupling stub segment EC. Then, a current generated by some charges flows toward the first grounding point 8. A resonance at a second preset band may be jointly formed by coupling the second coupling stub segment EC with the open stub segment AB on the metal side frame. The second preset frequency band may include a frequency band for wireless communication. For example, the second preset frequency band may be a frequency band for wireless local area networking, which may include a frequency of 2.4 GHz, i.e. at wireless fidelity (WiFi) frequency. Radiofrequency signals of WiFi frequency band above are radiated out through the second end of the IFA, i.e. the E point.

Figure 7:
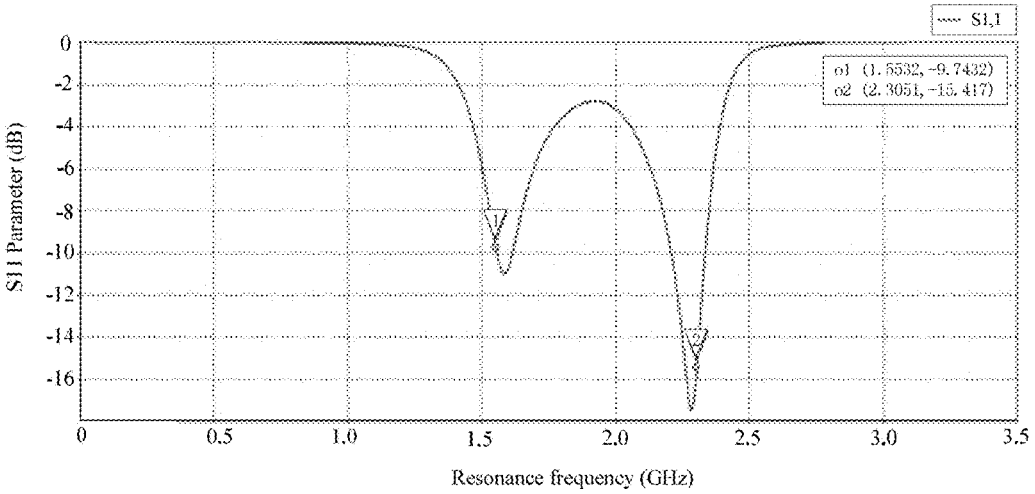
FIG. 7 is a schematic diagram illustrating a resonance test result of an antenna module according to an example of the present disclosure.

It can be seen from a resonance test result of an antenna module illustrated in FIG. 7 that the antenna module provided according to an example of the present disclosure may excite two antenna resonance points at the same time, i.e. a first resonance point o1 and a second resonance point o2. The first resonance point o1 has a resonance frequency of 1.5532 GHZ with S11 parameter value being −9.7432 dB, and the second resonance point o2 has a resonance frequency of 2.3051 GHz with S11 parameter value being −15.417 dB.

The S11 parameter in the FIG. 7 is one of parameters of antenna S that indicates echo loss characteristics. The larger the parameter is, the larger the echo loss of the antenna is and the worse the antenna efficiency is.

It can be seen that the antenna module provided in the present disclosure may realize two-in-one antenna of positioning and wireless communication without clearance in an electronic device. More specifically, the antenna module may realize two-in-one antenna for GPS and WiFi.

Figure 8A:
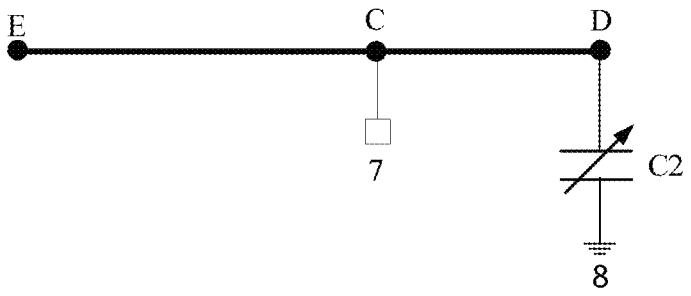
FIG. 8A is a schematic diagram illustrating a structure of a matching circuit of an antenna module according to an example of the present disclosure.
Figure 8B:
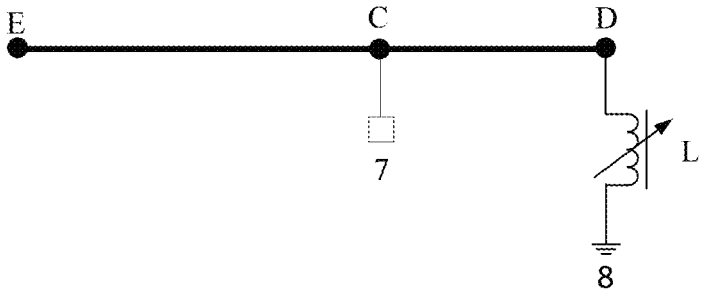
FIG. 8B is a schematic diagram illustrating a structure of a matching circuit of an antenna module according to another example of the present disclosure.
Figure 8C:
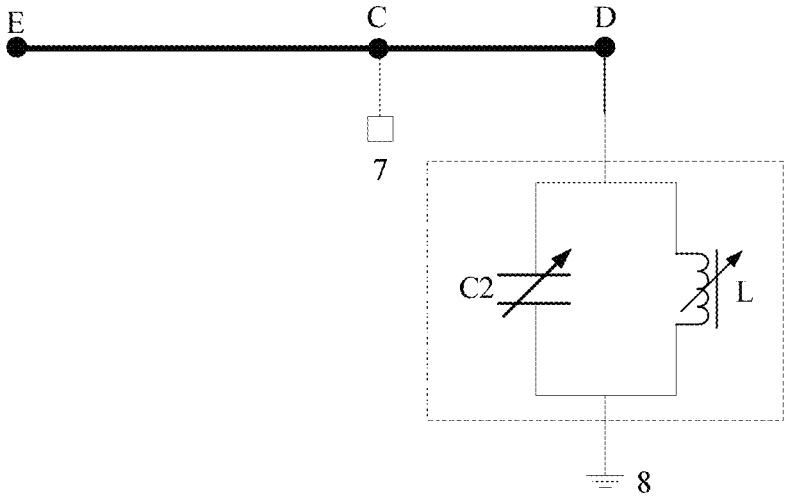
FIG. 8C is a schematic diagram illustrating a structure of a matching circuit of an antenna module according to still another example of the present disclosure.

According to another example of the present disclosure, a matching circuit may be connected between the first end of the above feed coupling stub and the first grounding point so as to realize slight adjustment of frequency for an antenna resonance point and improve the antenna efficiency. In another example of the present disclosure, parameter values of electric components in the above matching circuit may be adjustable, for example, the above electric component may be an adjustable capacitor C2 as shown in FIG. 8A, or may also be an adjustable inductor L as shown in FIG. 8B, or may be an adjustable assembly formed by the adjustable capacitor C2 and the adjustable inductor L as shown in FIG. 8C.

The resonance frequency of the antenna module may be adjusted by adjusting the position of the second grounding point or the parameter values of the electric components in the matching circuit or the like.

With a target resonance frequency as 1550 MHz, if the frequency of the first resonance point of the antenna module is 1580 MHz at present, the frequency may be adjusted by at least one of the following manners so that the frequency can be close to the target resonance frequency 1550 MHz.

In a first manner, if no matching circuit is connected between the first end of the feed coupling stub and the first grounding point, the connection position of the second grounding point 9 and the metal side frame 1 shown in FIG. 4A or 4B may be lowered, that is, the position of the middle frame connecting part 31 at the point A is lowered to increase the length of the slot so that the equivalent length of the antenna can be increased, thereby lowering the resonance frequency of the first resonance point of the antenna module.

In the above process, the adjustment of the resonance frequency may be carried out by adjusting the equivalent length of the antenna. The relationship of the equivalent length of antenna and the resonance frequency used herein is as follows:

When the equivalent length of the antenna is ¼ of a wavelength of a radio signal, the transmitting and receiving efficiency of the antenna, i.e. the efficiency of the antenna is the highest. It can be known that the frequency, i.e. the wavelength, of a transmission signal and a reception signal of the antenna may be decided by the equivalent length of the antenna. A corresponding best antenna equivalent length can be calculated based on the above relationship as long as working frequency band of the antenna, i.e. the central frequency of the transmission and reception signals, namely, the frequency of the above target resonance point is known.

In a second manner, if a matching circuit is connected between the first end of the feed coupling stub and the first grounding point in the above antenna module, and is the same as shown in FIG. 8A, a capacitance value of the adjustable capacitor C2 shown in FIG. 8A may be reduced. Since the capacitor has the filtering effect of passing high frequency and blocking low frequency, the resonance frequency of the first resonance point of the antenna module can be reduced by reducing the capacitance value of the C2.

In a third manner, if the matching circuit of the above antenna module is as shown in FIG. 8B, the induction value of the adjustable inductor L shown in FIG. 8B may be increased. Since the inductor L has the filtering effect of passing low frequency and blocking high frequency, the resonance frequency of the first resonance point of the antenna module can be reduced by increasing the induction value of the L.

Of course, if the above matching circuit is as shown in FIG. 8C, the adjustment principle is same as above. More fine adjustment for the resonance frequency of the antenna module may be realized by cooperative adjustment of the parameters of the inductor and the capacitor, thereby lowering the adjustment difficulty of the antenna and increasing the adjustment efficiency and accuracy of the antenna.

On the contrary, if the resonance frequency of a resonance point currently under test is lower than the target resonance frequency, reverse adjustment may be performed based on the above adjustment principle so that the resonance frequency can be close to the target resonance frequency, thereby increasing the antenna efficiency, which will not be repeatedly described herein.

Further, the present disclosure also provides an electronic device including a display module, a middle frame, a main board, an antenna module, where the display module is carried on the top of the middle frame and the main board is connected to the bottom of the middle frame. The antenna module may include a metal side frame with a breaking seam, and a feed coupling stub. A long side of the feed coupling stub is spaced at a preset distance from an inner side of the metal side frame. The feed coupling stub and the middle frame are arranged in parallel between the display module and the main board. A side of the middle frame is connected to the inner side of the metal side frame through middle frame connecting parts. A first end that is on the feed coupling stub and is adjacent to the breaking seam is electrically connected with a grounding part of the main board to form a first grounding point of the antenna module. The feed coupling stub is electrically connected with a radiofrequency module on the main board through a contact point to form a feed point of the antenna module. The middle frame connecting part adjacent to the second end of the feed coupling stub works as a second grounding point of the antenna module. A slot is opened between the inner side of the metal side frame and a side that is on the display module and substantially parallel to the long side of the feed coupling stub.

Figure 9:
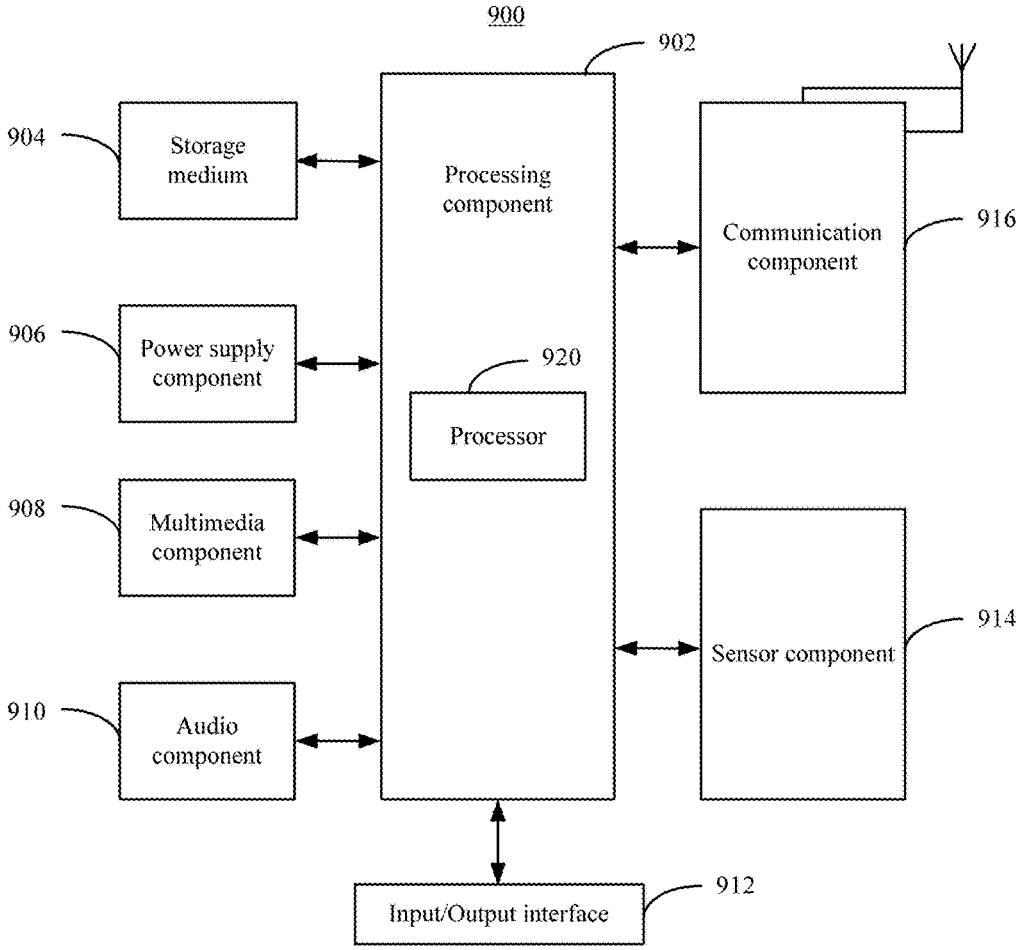
FIG. 9 is schematic diagram illustrating a structure of an electronic device according to an example of the present disclosure.

FIG. 9 is a schematic diagram illustrating a structure of an electronic device according to an example of the present disclosure. An antenna module shown in any of the above examples may be arranged in the electronic device. The electronic device 900 may include one or more of a processing component 902, a storage medium 904, a power supply component 906, a multimedia component 908, an audio component 910, an input/output interface 912, a sensor component 914 and a communication component 916.

The processing component 902 usually controls the entire operation of the device 900, such as operations associated with display, telephone call, data communication, camera operation and recording. The processing component 902 may include one or more processors 920 for executing instructions. In addition, the processing component 902 may include one or more modules for facilitating interaction with other components. For example, the processing component 902 may include a multimedia module for facilitating interaction of the multimedia component 908 and the processing component 902.

The storage medium 904 is configured to store different types of data to support the operation on the device 900. Examples of such data include instructions, contact data, phonebook data, messages, pictures, videos, and so on for any application or method that is operated on the device 900. The storage medium 904 may be implemented by any type of volatile or non-volatile memory devices or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, a disk or a CD.

The power supply component 906 supplies power to different components of the device 900. The power supply component 906 may include a power management system, one or more power sources, and other components relating to generating, managing and distributing power for the device 900.

The multimedia component 908 may include a screen providing an output interface between the device 900 and a user. In some examples, the screen may include a liquid crystal display (LCD), and a touch panel (TP). If the screen includes a touch panel, the screen may be implemented as a touch screen to receive an input signal from a user. The touch panel includes one or more touch sensors to sense touch, slip and gestures on the touch panel. The touch sensor may not only sense the boundary of a touch or slip operation but also detect duration and pressure relating to the touch or slip operation. In some examples, the multimedia component 908 may include a front-facing camera and/or a rear camera. When the device 900 is in an operating mode, such as in a shooting mode or a video mode, the front-facing camera and/or the rear camera may receive external multimedia data. Each of the front-facing camera and the rear camera may be a fixed optical lens system or may be capable of focal length and optical zoom.

The audio component 910 is configured to output and/or input an audio signal. For example, the audio component 910 includes a microphone (MIC). When the device 900 is in an operating mode, for example, in a call mode, a recording mode or a speech recognition mode, the microphone is configured to receive an external audio signal. The received audio signal may be further stored in the storage medium 904 or sent via the communication component 916. In some examples, the audio component 910 also includes a speaker for outputting an audio signal.

The I/O interface 912 provides an interface between the processing component 902 and a peripheral interface module. The peripheral interface module may be a keyboard, click wheel, a button and the like. Such buttons may include but not limited to: a home button, a volume button, a start button and a lock button.

The sensor component 914 includes one or more sensors for evaluating states of the device 900 in different aspects. For example, the sensor component 914 may detect the on/off state of the device 900, and relative locations of components, for example, the component is a display and a keypad of the device 900. The sensor component 914 may also detect a position change of the device 900 or one component of the device 900, the presence or absence of contact of a user with the device 900, an orientation or acceleration/deceleration of the device 900 and a temperature change of the device 900. The sensor component 914 may include a proximity sensor configured to detect presence of a nearby object without any physical contact. The sensor component 914 may also include an optical sensor, such as a CMOS or CCD image sensor to be used in imaging application. In some examples, the sensor component 914 may also include an acceleration sensor, a gyroscope sensor, a magnetic sensor, a pressure sensor, or a temperature sensor.

The communication component 916 is configured to facilitate wired or wireless communication between the device 900 and other devices. The device 900 may access a wireless network based on a communication standard, such as Wifi, 2G, 3G, 4G, 5G or a combination thereof. In an example, the communication component 916 may receive a broadcast signal or broadcast-related information from an external broadcast management system via a broadcast channel. In an example, the communication component 916 may also include a Near Field Communication (NFC) module to facilitate short-range communications. For example, the NFC module may be implemented based on Radio Frequency Identification (RFID) technology, Infrared Data Association (IrDA) technology, Ultra Wide Band (UWB) technology, Bluetooth (BT) technology and other technology.

In an example, the device 900 may be implemented by one or more of Application Specific Integrated Circuit (ASIC), Digital Signal Processor (DSP), Digital Signal Processing Device (DSPD), Programmable Logic Device (PLD), Field Programmable Gate Array (FPGA), controller, microcontroller, microprocessor and other electronic components.

In an example, there is also provided a non-transient machine readable storage medium including instructions, for example, a storage medium 904 including instructions. The instructions may be executed by a processor 920 of the device 900. For example, the non-transient machine readable storage medium may be Read-Only Memory (ROM), Random Access Memory (RAM), CD-ROM, magnetic tape, floppy disk and optical data storage devices and so on.

Alternatively, the feed coupling stub may include a metal strip. For example, the feed coupling stub may be a metal strip.

Alternatively, a stub between the contact point and the first end forms a first coupling stub; and a stub between the contact point and the second end forms a second coupling stub.

Alternatively, the length of the second coupling stub is greater than that of the first coupling stub.

Alternatively, a feed signal may excite resonance of a first preset frequency band by coupling the first coupling stub and a part of the metal side frame between the second grounding point and the breaking seam.

Alternatively, the feed signal may excite resonance of a second frequency band by coupling the second coupling stub and a part of the metal side frame between the second grounding point and the breaking seam.

Alternatively, the slot is opened on the front face of the electronic device and injection-molded to sealingly connect with the metal side frame of the electronic device.

Alternatively, a matching circuit is connected between the first end of the feed coupling stub and the first grounding point.

Alternatively, the matching circuit may include a capacitor and/or an inductor.

Alternatively, the width of the slot may range from 0.5 mm to 3 mm.

The technical solutions provided in an example of the present disclosure may include the following benefits.

In an antenna module provided in an example of the present disclosure, a slot may be opened between a side of a metal side frame with a breaking seam and a side of a display module and a long strip-shaped metal sheet may be arranged below the edge of the display module forming the slot so that the long strip-shaped metal sheet is parallel to the above slot. The above long strip-shaped metal sheet serves as a feed coupling stub and may excite electromagnetic waves of preset working frequency bands by coupling with the metal side frame forming the slot and then radiate the electromagnetic waves from the front face of an electronic device through the above slot. Since it is not necessary to cut off the metal side frame of the electronic device to reserve a clearance for an antenna, the influence caused by a user by holding the metal side frame on the performance of the antenna can be effectively avoided, thereby improving the performance of the antenna. The slot radiating antenna signals may be opened on the front face of the electronic device, therefore, it is more convenient to adopt a complex process to cover the slot in the process of sealing up the slot with insulating materials so that the slot will almost not affect the external appearance of the electronic device, thereby improving the aesthetic degree of the electronic device.

After considering the specification and practicing the present disclosure, the persons of skill in the prior art may easily conceive of other implementations of the present disclosure. The present disclosure is intended to include any variations, uses and adaptive changes of the present disclosure. These variations, uses and adaptive changes follow the general principle of the present disclosure and include common knowledge or conventional technical means in the prior art not disclosed in the present disclosure. The specification and examples herein are intended to be illustrative only and the real scope and spirit of the present disclosure are indicated by the claims of the present disclosure.

It is to be understood that the present disclosure is not limited to the precise structures described above and shown in the accompanying drawings and may be modified or changed without departing from the scope of the present disclosure. The scope of protection of the present disclosure is limited only by the appended claims.

What is claimed is:

1. An antenna module arranged in an electronic device, the antenna module comprising:

a metal side frame comprising a breaking seam; and a feed coupling stub having a first end and a second end, wherein a long side of the feed coupling stub is spaced at a preset distance from an inner side of the metal side frame, wherein the feed coupling stub and a middle frame of the electronic device are arranged in parallel between a display module and a main board of the electronic device;

wherein the inner side of the metal side frame is connected with a side of the middle frame through middle frame connecting parts;

wherein the first end of the feed coupling stub is adjacent to the breaking seam and is electrically connected with a grounding part of the main board to form a first grounding point of the antenna module;

wherein the feed coupling stub is electrically connected with a radiofrequency module of the main board through a contact point to form a feed point of the antenna module;

wherein the middle frame connecting part adjacent to the second end of the feed coupling stub works as a second grounding point of the antenna module;

wherein a slot is opened between the inner side of the metal side frame and a side that is on the display module and substantially paralleled to the long side of the feed coupling stub and wherein the slot has a width that ranges from 0.5 mm to 3 mm.

2. The antenna module according to claim 1, wherein the feed coupling stub includes a metal strip.

3. The antenna module according to claim 1, wherein the feed coupling stub comprises:

a first coupling stub between the contact point and the first end; and a second coupling stub between the contact point and the second end.

4. The antenna module according to claim 3, wherein a length of the second coupling stub is greater than that of the first coupling stub.

5. The antenna module according to claim 4, wherein a feed signal excites a resonance of global positioning system (GPS) frequency band by coupling the first coupling stub and a part of the metal side frame between the second grounding point and the breaking seam.

6. The antenna module according to claim 4, wherein a feed signal excites a resonance of wireless communication frequency band by coupling the second coupling stub and a part of the metal side frame between the second grounding point and the breaking seam.

7. The antenna module according to claim 1, wherein the slot is opened on a front face of the electronic device and injection-molded to sealingly connect with the metal side frame.

8. The antenna module according to claim 1, wherein a matching circuit is connected between the first end of the feed coupling stub and the first grounding point.

9. The antenna module according to claim 8, wherein the matching circuit comprises at least one component chosen from a capacitor and an inductor.

10. An electronic device, comprising:

a display module;

a main board in communication with the display module;

a middle frame disposed between the display module and the main board, wherein the display module is disposed on top of the middle frame and the main board is connected to bottom of the middle frame; and an antenna module, comprising a metal side frame comprising a breaking seam; and a feed coupling stub having a first end and a second end; wherein a long side of the feed coupling stub is spaced at a preset distance from an inner side of the metal side frame;

the feed coupling stub and the middle frame are arranged in parallel between the display module and the main board;

a side of the middle frame is connected with the inner side of the metal side frame through middle frame connecting parts;

the first end of the feed coupling stub is adjacent to the breaking seam and is electrically connected with a grounding part of the main board to form a first grounding point of the antenna module;

the feed coupling stub is electrically connected with a radiofrequency module of the main board through a contact point to form a feed point of the antenna module;

the middle frame connecting part adjacent to the second end of the feed coupling stub works as a second grounding point of the antenna module;

a slot is opened between the inner side of the metal side frame and a side that is on the display module and substantially paralleled to the long side of the feed coupling stub, and wherein the slot has a width that ranges from 0.5 mm to 3 mm.

11. The electronic device according to claim 10, wherein the feed coupling stub includes a metal strip.

12. The electronic device according to claim 10, wherein the feed coupling stub comprises:

a first coupling stub between the contact point and the first end; and a second coupling stub between the contact point and the second end.

13. The electronic device according to claim 12, wherein a length of the second coupling stub is greater than that of the first coupling stub.

14. The electronic device according to claim 13, wherein a feed signal excites a resonance of global positioning system (GPS) frequency band by coupling the first coupling stub and a part of the metal side frame between the second grounding point and the breaking seam.

15. The electronic device according to claim 13, wherein a feed signal excites a resonance of wireless communication frequency band by coupling the second coupling stub and a part of the metal side frame between the second grounding point and the breaking seam.

16. The electronic device according to claim 10, wherein the slot is opened on a front face of the electronic device and injection-molded to sealingly connect with the metal side frame.

17. The electronic device according to claim 10, wherein a matching circuit is connected between the first end of the feed coupling stub and the first grounding point.

18. The electronic device according to claim 17, wherein the matching circuit comprises at least one component chosen from a capacitor and an inductor.

* * * * *